United States Patent [19]

Fresard

[11] 4,106,419

[45] Aug. 15, 1978

[54] SEWING MACHINE

[75] Inventor: Marcel Fresard, Petit-Lancy, Switzerland

[73] Assignee: Mefina S.A., Fribourg, Switzerland

[21] Appl. No.: 775,652

[22] Filed: Mar. 8, 1977

[30] Foreign Application Priority Data

Mar. 16, 1976 [CH] Switzerland ..... 3234/76

[51] Int. Cl.[2] ..... D05B 3/02

[52] U.S. Cl. ..... 112/158 A

[58] Field of Search ..... 112/158A, 158 R, 158 D

[56] References Cited

U.S. PATENT DOCUMENTS 2,971,482 2/1961 Koike ..... 112/158 A 3,242,890 3/1966 Fresard ..... 112/158 R 3,699,910 10/1972 Urciola et al. ..... 112/158 A

*Primary Examiner*—Werner H. Schroeder

*Assistant Examiner*—Peter Nerbun

*Attorney, Agent, or Firm*—Emory L. Groff, Jr.

[57] ABSTRACT

A zig-zag sewing machine has a series of cams juxtaposed on a drive shaft for controlling oscillation of a needle-bar cradle. Cam selection is achieved by a manual selector having two cam profiles, one of which controls a lever to space a feeler apart from the cams at the moment when the other cam profile controls another lever to move the feeler parallel to the drive shaft to change the cam with which the feeler cooperates.

1 Claim, 1 Drawing Figure

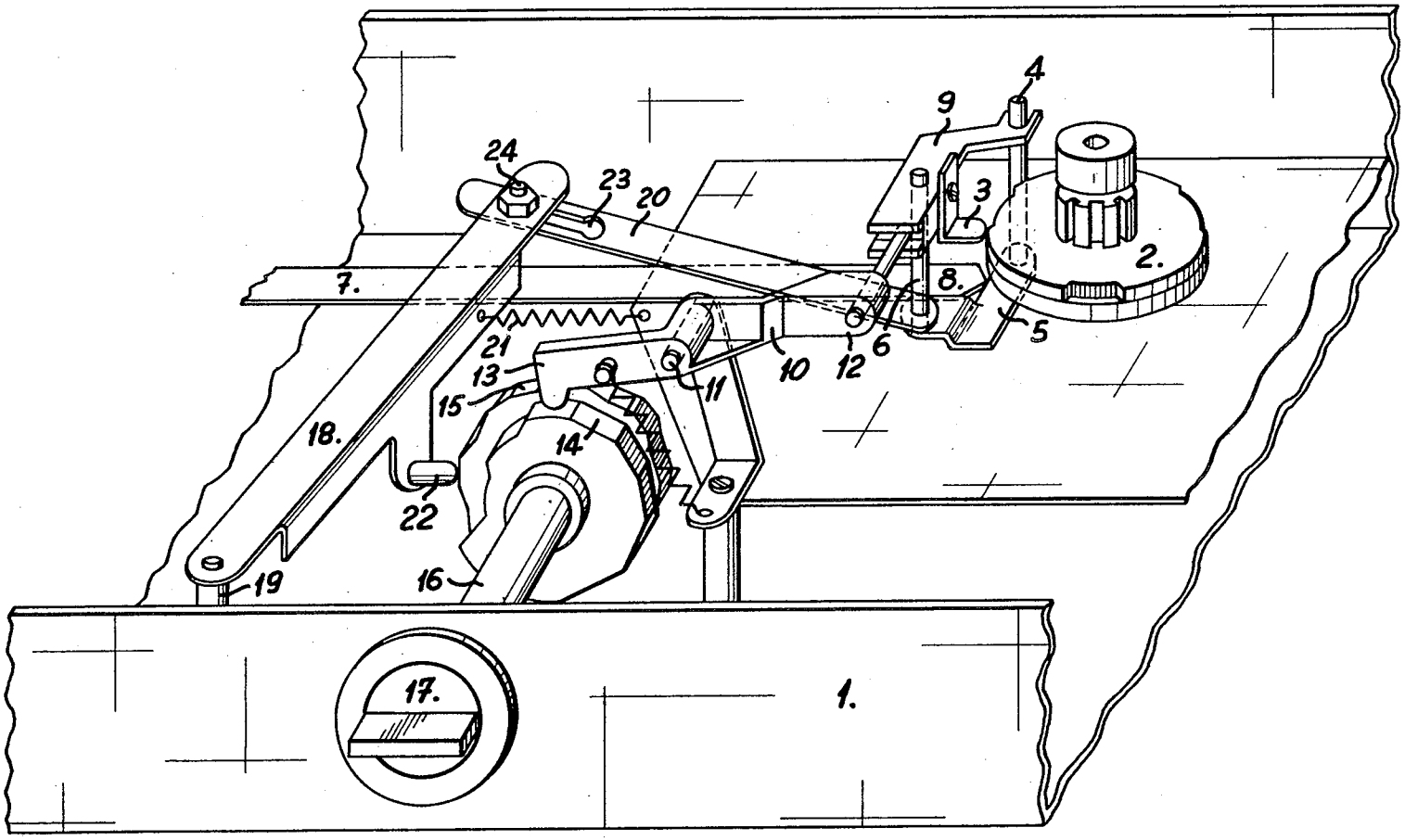
1.
2.
3
4
5
6
7.
8.
9
10
11
12
13
14
15
16
17.
18.
19
20
21
22
23
24

SEWING MACHINE

The invention concerns zig-zag sewing machines of the type comprising a series of cams juxtaposed on a drive-shaft for controlling oscillation of a cradle in which a needle-bar slides, a set of transmission elements comprising a slide able to oscillate about an axis parallel to said drive shaft and a feeler, fixed for rotation with the slide and able to move parallel to said drive shaft by actuation of a manual cam-selection control including first and second cam profiles, a first cam profile which enables the feeler to be spaced apart from the series of juxtaposed cams, and a second cam profile which produces movement of the feeler parallel to said drive shaft.

Such a machine has already been described in U.S. Pat. No. 3,242,890, but it has the drawback of requiring a setting to zero of the member controlling the amplitude of the transverse movements of the needle-bar before actuating the manual cam-selection control. In effect, only when the feeler is spaced apart from the series of juxtaposed cams can it be moved, without a risk of damage, parallel to the cam shaft by actuation of the manual cam-selection control.

To remedy this drawback, a sewing machine according to the invention is characterized in that the first cam profile cooperates with a cam follower fixed on a lever articulated by one of its ends to the frame of the machine and by its other end to a rod connecting it to the slide.

The accompanying drawing shows, schematically and by way of example, an embodiment of sewing machine according to the invention.

The single FIGURE of the drawing is a partial perspective view showing a manual cam-selection control lodged in the upper arm of a sewing machine.

The upper arm 1 of a zig-zag sewing machine contains a horizontal drive shaft driving, by means of a connecting-rod and crank device, a needle bar with a vertical to-and-fro movement; this mechanism is of conventional construction and is not shown in the drawing.

For the control of transverse movements of the needle-bar, the machine comprises a series of juxtaposed cams 2 fixed on a vertical drive shaft itself driven in rotation by the above-mentioned horizontal shaft. Each of the juxtaposed cams 2 is able to act on a feeler 3 fixed on a support 9 oscillating about a vertical pin 4. A slide 5 also oscillatably mounted about the pin 4 is rotatably connected with the support 9 of feeler 3 by a connecting rod 6. Hence, the slide 5 oscillates dependent upon the oscillation transmitted to the feeler 3 by one of the cams 2 and is retransmitted, a known manner, to a cradle (not shown) in which the needle-bar slides, by a rod 7 having a finger 8 engaging the slide 5.

The support 9 of feeler 3 is movable vertically by a lever 10 pivoting about a horizontal pin 11. One end 12 of lever 10 is pivotally connected to the support 9, whereas its other end 13 is supported on a cam profile 14 enabling manual control of the vertical position of feeler 3. During its vertical movement, the support 9 is guided by the vertical pin 4 and the connecting rod 6 on which it is slidably mounted.

The first cam profile 14 forms part of a cam with a double profile 14, 15 mounted on a rotary shaft 16 manually controlled by a button 17. The second cam profile 15 actuates a lever 18 of which one end is oscillatably mounted on a pivot 19 fixed on the frame of the machine and whose other end is connected by means of an eccentric (not shown) to an end of a rod 20 whose other end pivots about the connecting rod 6.

The cam profiles 14 and 15 are such that when the cam profile 14 controls passage of the feeler 3 from one cam of the series of juxtaposed cams 2 to another, the profile 15 pushes, against the action of spring 21, a follower 22 fixed on lever 18. Hence, the feeler 3 is spaced apart from the cams 2 during the selection of the cams 2 during each passage from one cam 2 to another, without it being necessary to move the finger 8 of the rod 7 along the slide 5 beyond the pin 4 about which the latter oscillates.

As shown in the drawings, an elongate slot 23 is provided in the end of rod 20 which is connected to lever 18, so that the rod 20 may oscillate during oscillation of the slide 5 by a cam 2, without such action producing oscillation of lever 18 about its pivot 19. Hence, during oscillation of the slide 5, the slot 23 moves around a stud (not shown in the drawing) of the eccentric providing connection between the lever 18 and the rod 20. This stud is mounted eccentric to a screw 24 for securement to the lever 18, in a manner to permit, during assembly of the machine, adjustment of the position of spacing apart of the feeler 3 in relation to the maximum diameter of the cams 2.

Numerous variations of the device described and shown in the drawing may be envisaged.

Thus, if the series of juxtaposed cams 2 were mounted on a horizontal drive shaft, the assembly of the device for selecting a cam 2 and spacing the feeler 3 would be modified accordingly.

I claim:

1. In a zig-zag sewing machine comprising a frame housing a series of cams juxtaposed on a drive-shaft for controlling oscillation of a needle-bar cradle by means of a set of transmission elements comprising a slide able to oscillate about an axis parallel to said drive-shaft and a feeler rotatably connected with the slide and able to move parallel to said drive shaft, and manual cam-selection means for controlling movement of said feeler, said cam-selection means including first and second cam profiles, said first cam profile enabling the feeler to be spaced apart from the series of juxtaposed cams, said second cam profile producing movement of the feeler parallel to said drive-shaft, the improvement comprising a lever having first and second ends, said first end articulated to the frame of the machine, a rod connected to the second end of said lever and connecting it to said slide, a cam follower fixed on said lever, said first cam profile cooperating with said cam follower, a second lever including first and second ends and pivotally mounted on the frame of the machine about an axis perpendicular to said drive-shaft, said second cam profile cooperating with the first end of said second lever, the second end of said second lever controlling movement of said feeler.

* * * * *